US007430803B2

(12) United States Patent
Li

(10) Patent No.: US 7,430,803 B2
(45) Date of Patent: Oct. 7, 2008

(54) GAS REMOVING APPARATUS FOR REMOVING NON-CONDENSATE GAS FROM A HEAT PIPE AND METHOD FOR THE SAME

(76) Inventor: Jia-Hao Li, No. 2, Lane 127, Dang Ke St., Kang Shan Jen, Kao Hsiung Hsien (TW)

( * ) Notice: Subject to any disclaimer, the term of this patent is extended or adjusted under 35 U.S.C. 154(b) by 611 days.

(21) Appl. No.: 11/022,662

(22) Filed: Dec. 28, 2004

(65) Prior Publication Data

US 2006/0150647 A1 Jul. 13, 2006

(51) Int. Cl.

| | |
|---|---|
| ***B21D 53/02*** | (2006.01) |
| ***B21D 21/00*** | (2006.01) |
| ***B21D 39/00*** | (2006.01) |
| ***B23P 6/00*** | (2006.01) |
| ***B23K 31/00*** | (2006.01) |
| ***F28D 15/00*** | (2006.01) |

(52) U.S. Cl. ..... 29/890.032; 29/890.03; 29/890.053; 165/104.18; 165/104.19; 165/104.21; 165/104.26; 165/104.32

(58) Field of Classification Search ..... 29/890.032, 29/890.03, 890.053, 890.054, 505, 423; 62/197, 62/98; 165/104.18, 104.19, 104.21, 104.26–27, 165/104.32, 104.33

See application file for complete search history.

(56) References Cited

U.S. PATENT DOCUMENTS

| | | | | |
|---|---|---|---|---|
| 4,106,171 | A * | 8/1978 | Basiulis | 290/890.032 |
| 6,230,407 | B1 * | 5/2001 | Akutsu | 290/890.032 |
| 2004/0194311 | A1 * | 10/2004 | Hsu | 29/890.032 |

* cited by examiner

*Primary Examiner*—David P. Bryant
*Assistant Examiner*—Alexander P Taousakis

(57) ABSTRACT

A method and gas removing apparatus removes non-condensate gas from a heat pipe. The gas removing apparatus includes at least one heating unit, a sealing unit and a height-adjusting unit. The heating unit heats the heat pipe and includes a clip to clamp the heat pipe. The sealing unit is placed atop the heating unit and outside an opening of the heat pipe. The height-adjusting unit supports the heating unit and adjusts a height of the heating unit according to the length of the heat pipe, whereby the clip clamps on a lower portion of the heat pipe. During the removing operation of the non-condensate gas, the heating unit only heats a bottom portion of the heat pipe.

2 Claims, 3 Drawing Sheets

GAS REMOVING APPARATUS FOR REMOVING NON-CONDENSATE GAS FROM A HEAT PIPE AND METHOD FOR THE SAME

BACKGROUND OF THE INVENTION

1. Field of the Invention

The present invention relates to a gas removing apparatus for removing non-condensate gas from a heat pipe and method for the same, and more particularly to a gas removing apparatus used in the process of removing non-condensate gas and method for the same.

2. Description of Prior Art

The conventional hear pipe generally includes means to remove non-condensate gas therein. For example, Taiwan patent gazette No. 593961 discloses a method and an apparatus to remove non-condensate gas in a heat pipe. However, in above patent, the apparatus clamps on the wall of the heat pipe with large contact area. The wall of the heat pipe tends to be damaged due to non-straight pipe and non-ideal design of the heating unit of the apparatus.

SUMMARY OF THE INVENTION

The present invention is to provide a gas removing apparatus for removing non-condensate gas from a heat pipe and method for the same. The gas removing apparatus uses a height-adjusting unit such that the gas removing apparatus heats a bottom portion of the heat pipe of varying length. Therefore, the operation of a clip of the gas removing apparatus will not influence the size variation of the heat pipe and the straightness of the heat pipe can also be ensured.

Accordingly, the present invention provides a gas removing apparatus for removing non-condensate gas from a heat pipe and method for the same. The gas removing apparatus comprises at least one heating unit, a sealing unit and a height-adjusting unit. The heating unit heats the heat pipe and has a clip to clamp the heat pipe. The sealing unit is placed atop the heating unit and outside an opening of the heat pipe. The height-adjusting unit supports the heating unit and adjusts a height of the heating unit according to the length of the heat pipe, whereby the clip clamps on a lower portion of the heat pipe. During the removing operation of the non-condensate gas, the heating unit only heats a bottom portion of the heat pipe.

The above summaries are intended to illustrate exemplary embodiments of the invention, which will be best understood in conjunction with the detailed description to follow, and are not intended to limit the scope of the appended claims.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
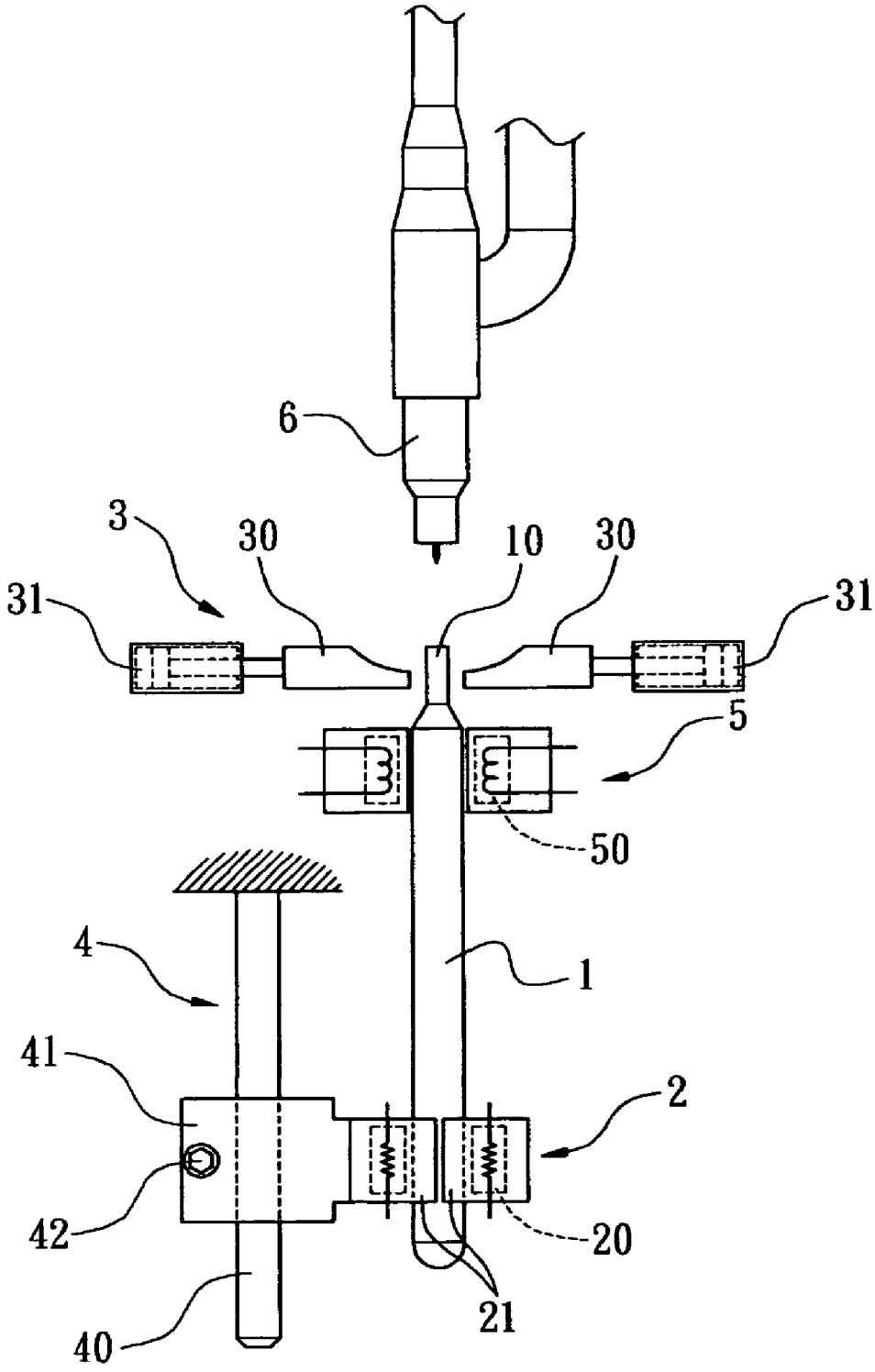
FIG. 1 shows a sectional view of a preferred embodiment according to the present invention.
Figure 2:
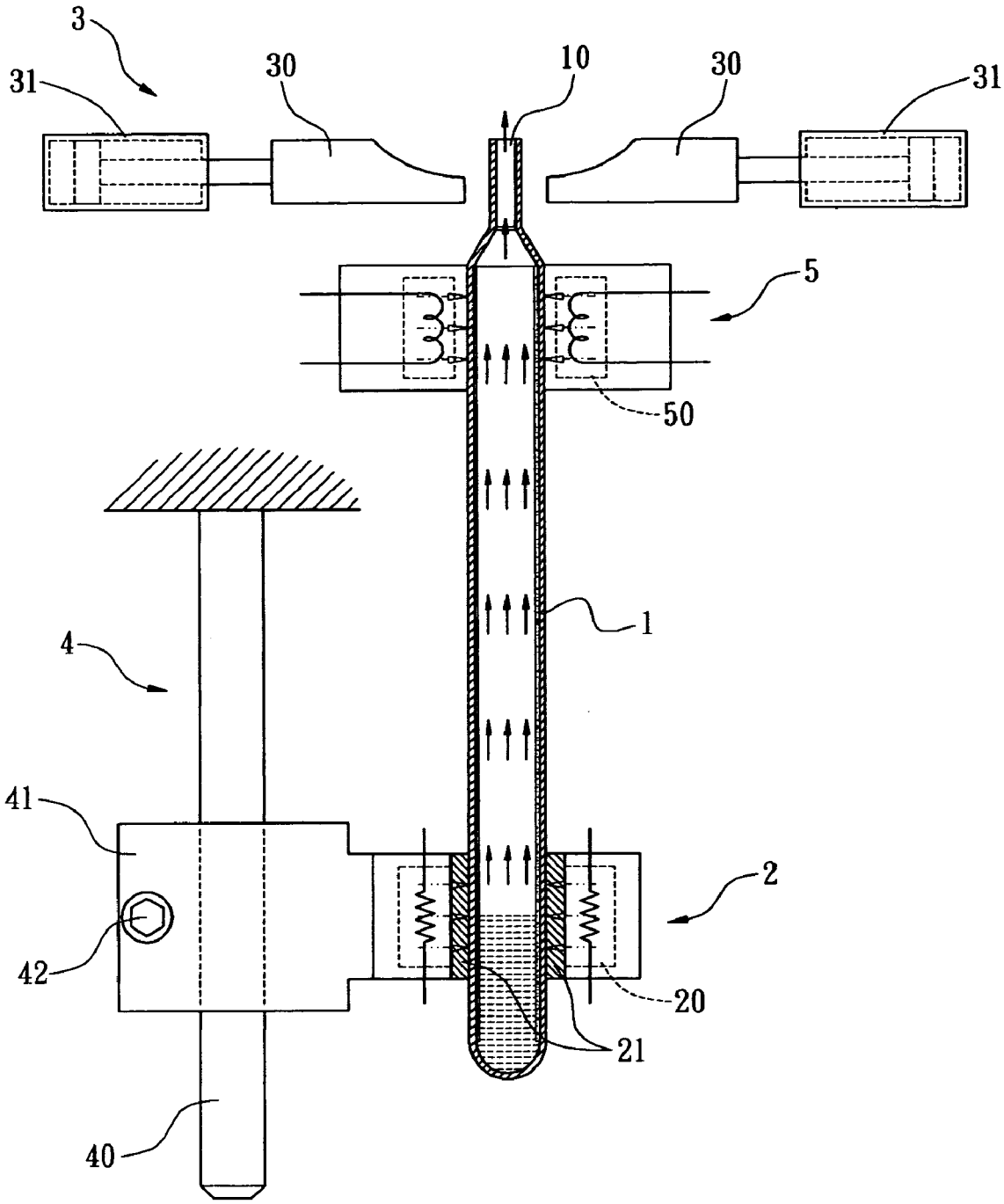
FIG. 2 shows a sectional view for explaining the operation of the present invention.
Figure 3:
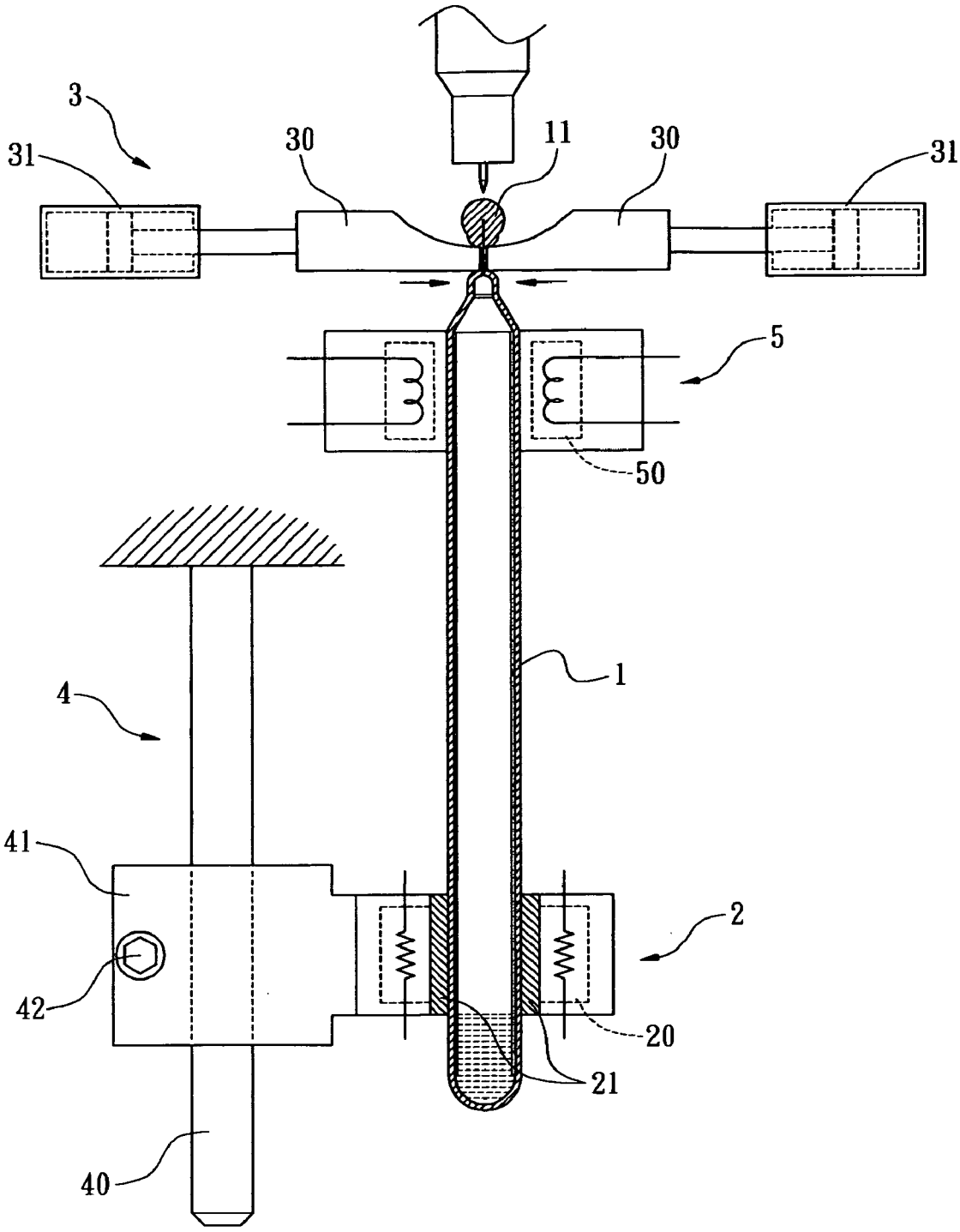
FIG. 3 shows another sectional view for explaining the operation of the present invention.

Please refer to FIG. 1 through FIG. 3 according to a preferred embodiment of the present invention. As shown in those figures, the present invention provides a gas removing apparatus for heat pipe, which can be used for single semi-finished heat pipe 1. The gas removing apparatus for heat pipe according to the present invention comprises a heating unit 2, a sealing unit 3 and a height-adjusting unit 4.

The heating unit 2 comprises a heater 20 for controlling heating amount and temperature. The heating unit 2 is arranged at a lower portion of the heat pipe 1 for heating the heat pipe 1. Moreover, the heating unit 2 could also comprise a plurality of heaters 20 arranged along a lengthwise direction of the heat pipe 1. Moreover, the heating unit 2 also comprises a clip 21 clamping on a lower portion of the heat pipe 1. The clip 21 just clamps on partial and local portion of the heat pipe 1. Therefore, the operation of the clip 21 will not influence the size variation of the heat pipe 1 and the straightness of the heat pipe 1 can also be ensured.

The sealing unit 3 comprises a sealing die 30 and a sealing mechanism 31 for opening and closing the sealing die 30. Moreover, the sealing unit 3 is arranged atop the heating unit 2 and outside the opening of the heat pipe 1, which is to be sealed. The opening is functioned as a gas vent 10 for removing non-condensate gas for the heat pipe 1. Moreover, the sealing die 30 has heater (not shown) with controlled temperature to ensure that the temperature nearby is higher than the saturated temperature during sealing operation.

The height-adjusting unit 4 comprises a guiding rod 40 outside the heat pipe 1 and parallel to the heat pipe 1. A sliding stage 41 is slidably arranged on the guiding rod 40 and can be moved upward and downward along the guiding rod 40. The sliding stage 41 can be fixed on the guiding rod 40 by a clamping element 42. The clamping element 42, such as a bolt, can tighten the sliding stage 41 on the guiding rod 40 with a predetermined height. The sliding stage 41 is used to support the heating unit 2. Therefore, the height of the heating unit 2 can be adjusted such that the clip 21 clamps a lower portion of the heat pipe 1 and the heating unit 2 heats the lower portion of the heat pipe 1.

Moreover, a distal clamping unit 5 is provided below the sealing unit 3 and placed at upper circumference of the heat pipe 1. The distal clamping unit 5 can be used with the clip 21 to clamp the heat pipe 1 in erected stand. The distal clamping unit 5 is configured to fit heat pipes 1 of different pipe dimension and can be provided with a heater 50 to heat an upper portion of the heat pipe 1.

The gas removing apparatus for heat pipe according to the present invention can be configured and assembled according to above description.

With reference to FIGS. 2 and 3, the heat pipe 1 is filled with working fluid when the heat pipe 1 is subjected to non-condensate gas removing operation. The heat pipes 1 is placed in erective stand and clamped by the heating unit 2 and the distal clamping unit 5. The heating unit 2 is clamped to a lower portion of the heat pipe 1. Moreover, a gas vent 10 is defined at top of the heat pipe 1 as shown in FIG. 2 and the heating unit 2 heats the bottom of the heat pipes 1 to raise temperature of the working fluid in isobaric manner when the gas vent 10 is still in opened state. When the working fluid reaches saturated temperature, the saturated temperature is kept until the working fluid boils and evaporates. The non-condensate gas within the pipe 1 is expelled by the evaporated fluid. The sealing unit 3 performs sealing process to the vent 10 of the heat pipe 10 when desired degas amount reaches. At this time, a spot welding unit 6 atop the sealing unit 3 performs spot welding to the vent 10 to form a sealed structure 11 as shown in FIG. 3, thus finishing degas and sealing operation for the heat pipe.

The method for removing gas from heat pipe according to the present invention can be performed by above steps.

To sum up, in the apparatus and method for removing gas from heat pipe according to the present invention, the distal clamping unit 5 is employed to clamp the heat pipe 1 of varying length. Only partial and local portion of the heat pipe 1 is clamped. Therefore, the size variation of the heat pipe 1 is not serious and the straightness of the heat pipe 1 can also be ensured.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A method for removing a non-condensate gas from a heat pipe, comprising the steps of:

providing a gas removing apparatus including:

a heating unit for heating the heat pipe and having a clip to clamp the heat pipe, a sealing unit placed atop the heating unit and outside an opening of the heat pipe, and having a sealing die and a sealing mechanism for opening and closing the sealing die, and a height-adjusting unit for supporting the heating unit and adjusting a height of the heating unit according to a length of the heat pipe, whereby the clip clamps on a lower portion of the heat pipe;

placing the heat pipe filled with a working fluid in an erective stand and clamped by the clip, the heat pipe having a gas vent at a top thereof;

using the heat unit to heat the bottom of the heat pipe to raise temperature of the working fluid when the gas vent is still in an opened state; and repelling the non-condensate gas within the pipe by an evaporated fluid produced by heating the working fluid.

2. The method as in claim 1, wherein the sealing die has a temperature higher than a saturated temperature during sealing operation.

* * * * *